United States Patent [19]

Patenaude et al.

[11] 4,345,505

[45] Aug. 24, 1982

[54] FIRING PIN LOCKING SYSTEM

[75] Inventors: Raymond A. Patenaude, Burlington; Steven R. Duke, Williston; John K. Coolidge, Colchester, all of Vt.

[73] Assignee: General Electric Company, Burlington, Vt.

[21] Appl. No.: 158,197

[22] Filed: Jun. 11, 1980

[51] Int. Cl.[3] ..... F41D 11/06

[52] U.S. Cl. ..... 89/154; 89/12; 89/190

[58] Field of Search ..... 89/154, 168, 176, 190

[56] References Cited

U.S. PATENT DOCUMENTS

| | | | |
|---|---|---|---|
| 1,057,329 | 3/1913 | Clarus | 89/190 |
| 2,962,936 | 12/1960 | Lippert et al. | 89/190 |
| 3,603,201 | 9/1971 | Aloi | 89/12 |
| 3,608,427 | 9/1971 | Colby | 89/176 |
| 3,834,272 | 9/1974 | Patenaude et al. | 89/190 |
| 4,114,511 | 9/1978 | Patenaude | 89/33 CA |

OTHER PUBLICATIONS

G. M. Chinn, The Machine Gun, vol. IV, Parts X and XI, pp. 371, 384, 385, Dept. of the Navy, 1955.

*Primary Examiner*—Stephen C. Bentley
*Attorney, Agent, or Firm*—Bailin L. Kuch

[57] ABSTRACT

A feature of this invention is the provision of a gun bolt having a firing pin which is movable to and between an aft disposition whereat the forward end of said pin is aft of the face of the gun bolt and a forward disposition whereat said forward end is forward of said face, locking means movable to and between a locked disposition whereat said gun bolt is locked to fixedly close the chamber of the gun and an unlocked disposition, and intermediate means responsive to the disposition of said locking means for locking said pin in its aft disposition when said locking means is not in its locked disposition.

5 Claims, 14 Drawing Figures

FIRING PIN LOCKING SYSTEM

The U.S. Government has rights in this invention pursuant to Contract No. F08635-77-C-0173 awarded by the United States Air Force.

BACKGROUND OF THE INVENTION

1. Field of the Invention

This invention relates to mechanisms for locking and actuation of the firing pins of gun bolts in automatic guns, such as Gatling type guns, and, more particularly, to such mechanisms in gun bolts where the bolts are locked by cammed locking lugs.

2. Description of the Prior Art

The use of cammed locking lugs to lock gun bolts to gun barrels is well known, and is shown, for example, in "The Machine Gun" by G. M. Chinn, Vol. IV, Parts X and XI, pp. 371, 384, 385, Dept. of the Navy, 1955. Therein are shown for example: "FIG. 6-76-Locking Rollers Are Cammed Free of Barrel Extension by Rails in Receiver." "FIG. 6-89 [and 6-90]-Recoiling Barrel Extension Cams Lugs Free of Bolt." In U.S. Pat. No. 3,608,427 issued Sept. 28, 1971 to R. H. Colby, there is shown a gun bolt which is locked by lugs which are nested in pockets in the recoiling gun barrel extension and which are swung out to lock the gun bolt by cam followers which ride in a stationary cam track. In U.S. Pat. No. 3,603,201, issued Sept. 7, 1971 to A. J. Aloi there is shown a firing pin in a drop lock type gun bolt in a Gatling type gun which is actuated by an aft annular cam. In U.S. Pat. No. 4,295,410, issued Oct. 20, 1981 to R. A. Patenaude et al there is shown a gun bolt in a Gatling type gun which is locked by locking lugs which are operated by a slide which is controlled by a supplemental annular cam.

BRIEF DESCRIPTION OF THE INVENTION

It is an object of this invention to provide a mechanism for precluding projection of the firing pin of a gun bolt forward of the face of the gun bolt when the gun bolt is not in its locked position.

A feature of this invention is the provision of a gun bolt having a firing pin which is movable to and between an aft disposition whereat the forward end of said pin is aft of the face of the gun bolt and a forward disposition whereat said forward end is forward of said face, locking means movable to and between a locked disposition whereat said gun bolt is locked to fixedly close the chamber of the gun and an unlocked disposition, and intermediate means responsive to the disposition of said locking means for locking said pin in its aft disposition when said locking means is not in its locked disposition.

BRIEF DESCRIPTION OF THE DRAWING

These and other objects, features and advantages of the invention will be apparent from the following specification thereof taken in conjunction with the accompanying drawing in which.

DESCRIPTION OF THE INVENTION

This invention is incorporated in a gun bolt of the type shown in U.S. Pat. No. 4,294,158, issued Oct. 13, 1981 to R. A. Patnaude et al, which in turn is incorporated in a gun of the type having a small diameter rotor shown in U.S. Pat. No. 3,834,272 issued Sept. 10, 1974 to R. A. Patenaude et al and U.S. Pat. No. 4,114,511 issued Sept. 19, 1978 to R. A. Patenaude. Of course, the invention has utility in other gun bolts in other guns.

Figure 2:
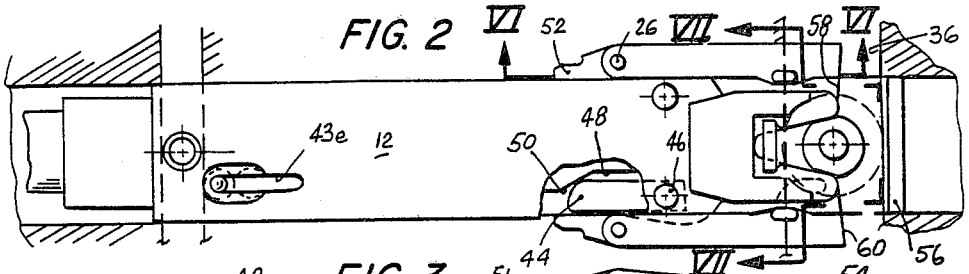
FIG. 2 is a top view of the gun bolt of FIG. 1 showing the gun bolt unlocked.
Figure 3:
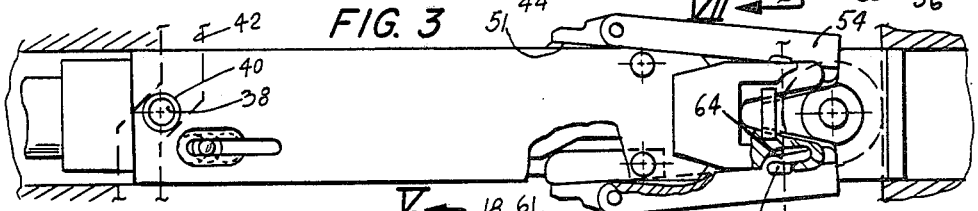
FIG. 3 is similar to FIG. 2 but showing the gun bolt partially locked.
Figure 4:
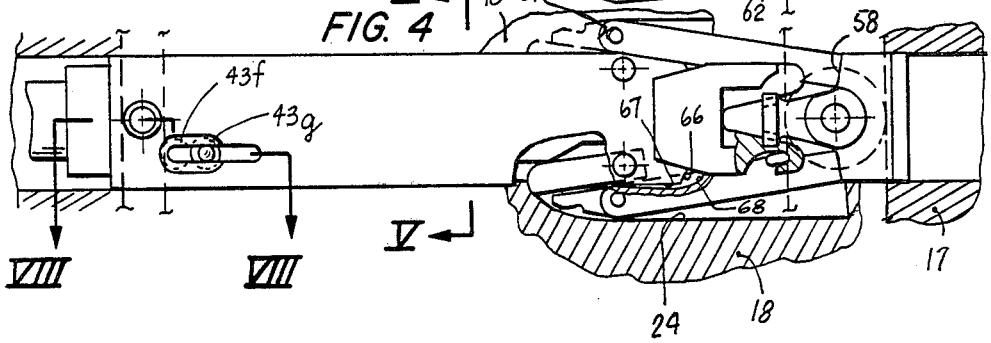
FIG. 4 is similar to FIG. 3 but showing the gun bolt fully locked.
Figure 1:
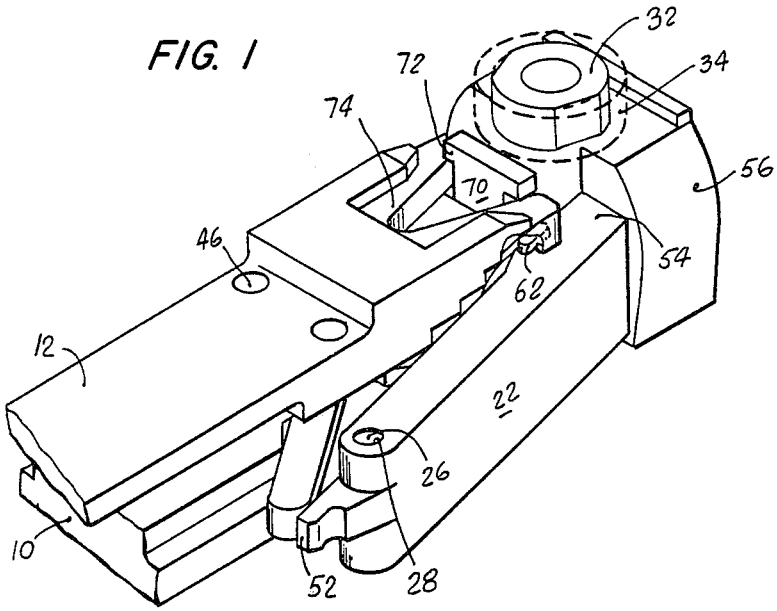
FIG. 1 is a perspective view of a portion of a gun bolt of the type shown in U.S. Pat. No. 4,294,158, issued Oct. 13, 1981 to R. A. Patenaude et al, which is improved by the incorporation of an embodiment of this invention.
Figure 7:
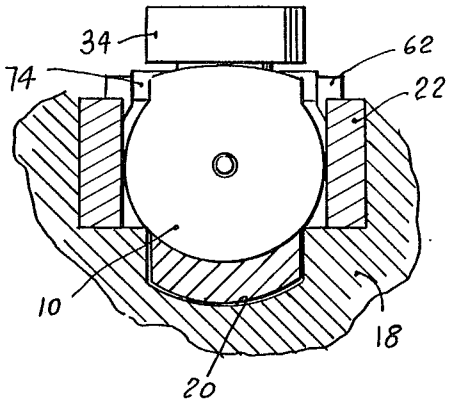
FIG. 7 is a partial detail view in transverse cross-section showing the gun bolt journaled in the rotor.
Figure 8:
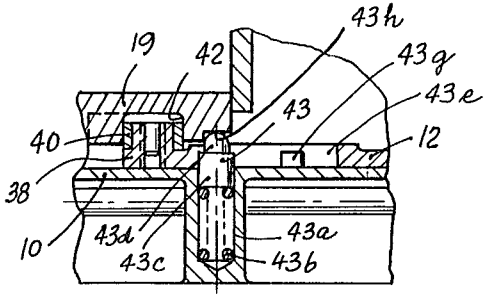
FIG. 8 is a partial detail view in longitudinal cross-section showing the cam follower and detent mechanism of the locking slide.
Figure 6:
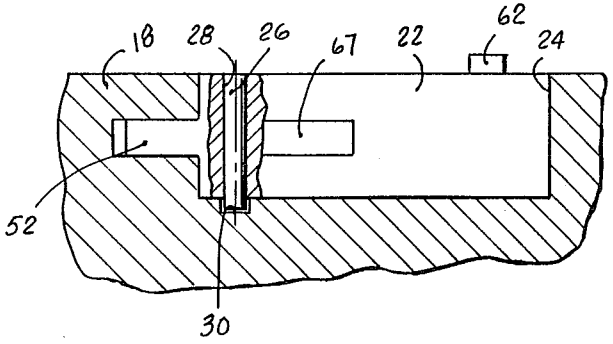
FIG. 6 is partial detail view in longitudinal cross-section showing the wing lock in elevation as nested in the pocket in the rotor.
Figure 5:
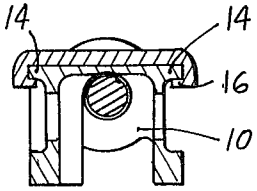
FIG. 5 is a partial detail view in transverse cross-section showing the locking slide captured to the body of the gun bolt.

The gun bolt embodying this invention as shown in FIG. 1 includes a bolt body 10 and a slide 12. As shown in FIG. 5, the body has, in part, a T-shaped cross-section wherein the ends of the "T" provide rails 14 and the slide has a pair of depending and inward-going sides 16 encircling the rails to capture the slide to the body while permitting longitudinal relative motion. There are a plurality of gun bolts, e.g., three, one for each gun barrel 17. The gun barrels are fixed to the rotor 18 which is journaled for rotation in a housing 19, and each gun bolt is journaled for longitudinal reciprocation in a respective channel 20 in the rotor, as shown in FIG. 7. As is well known, the rotor in a Gatling type gun serves as a receiver.

Each of a symmetric pair of locking lugs 22 is nested in a respective recess 24 in the rotor 18 adjacent the channel 20. A pin 26, which passes through a bore 28 in the lug 22 into a blind bore 30 in the rotor, pivotally captures the lug in the rotor.

Each gun bolt body 10 has a stud 32 fixed thereto on which is journaled a cam follower roller 34 which rides in a cam track 36 formed in the interior wall of the housing 19, and which cam track serves to reciprocate the bolt fore and aft as the rotor revolves about its longitudinal axis. The rotor may be driven by appropriate means, such as an external drive, as shown in U.S. Pat. No. 3,834,272, supra. Each slide 12 has a stud 38 fixed thereto on which is journaled a cam follower roller 40 which rides in a cam track 42 formed in the interior wall of the housing, and which cam track serves to reciprocate the slide relative to its respective gun bolt, as the assembly of the gun bolt and the slide reciprocates relative to the rotor. The cam track 42 is not continuous, but rather is provided only where necessary to provide relative movement between the slide and the bolt body. A detent mechanism is provided to hold the slide and the bolt body against relative movement. A plunger 43 is disposed in a blind bore 43*a* and is biased outwardly by a helical compression spring 43*b*. The plunger has a main body portion 43*c* of relatively large diameter and a cam follower portion 43*d* of relative smaller diameter. The follower portion clears and passes through a slot 43*e* in the slide. The body portion 43*c* will seat in either of two cups 43*f* or 43*g* in the slot, and when so seated, locks the slide of the bolt body. The plunger is withdrawn from either cup by means of a cam surface 43*h* depressing the follower against the bias of the spring.

Each of a symmetric pair of actuator lugs 44 is pivotally captured to the slide 12 by a respective pin 46 and nested within a respective recess 48 into the side of the gun bolt body 10. Each recess 48 has a respective ramp surface 50, which serves to cam the distal end of the lug 44 outwardly when the slide 12 is moved aft relative to the gun bolt body 10. As the distal end of the lug 44 moves outwardly it abuts a cam following surface 51 of the aft end 52 of the adjacent locking lugs 22 which is journaled on pivot 26 in the rotor and swings said aft end 52 outwardly and, thereby, the forward end 54 of the locking lug inwardly. As the forward end 54 swings inwardly, it enters a recess 55 in the bolt body aft of the head 56 of the bolt. This recess has an aft facing surface 58 which receives the forward facing and end surface 60 of the locking lug. Thus pressure against the face of the head 56 of the bolt body 10 is transmitted across the surfaces 58 and 60, through the locking lugs 22, to an arcuate surface 61 of the rotor 18.

Each of the pair of locking lugs 22 also has a respective stud 62 fixed to the forward end. The forward end of the slide 12 has a pair of somewhat arcuate slots 64 cut into its underface. As the slide 12 progressively moves aft, the lugs 44 progressively swing out, the lug aft ends 52 progressively move out, and the lug forward ends 54 progressively move in and the lugs 62 progressively enter into the respective arcuate slots 64. When the slide 12 is fully aft, the lugs 62 are fully into the blind forward ends of the slots, so that the slide precludes any pivotal movement of the locking lug.

Thus the slide 12 which is controlled by its cam follower 40 in the cam track 42, not only drives the locking lugs into their bolt locking configuration by means of the ramp surfaces 50 and the actuator lugs 44, but also captures the locking lugs in their bolt locking configuration by means of the arcuate slots 64, so that any possibility of unlocking movement of the locking lugs at the time of firing is precluded.

The slide also has a symmetric pair of shoulders with respective ramp surfaces 66, which project into respective recesses 67 in each locking lug 22. Each recess has a cam following surface 68, and as the slide moves forwardly on the bolt body, the ramp surface 66 engages the surface 68 to cam the locking lugs outwardly, while concurrently the cut out 64 clears the stud 62.

A stud 70 is integral with the body of the gun bolt and has a cross bar having two ends 72 which overlie an upwardly facing surface 74 of the slide. These overlying ends preclude any possible upward movement of the slide which might otherwise tend to permit disengagement of the studs 62 from the arcuate slots 64.

A firing pin 100 is disposed in a longitudinal bore 102 in the gun bolt body 10. A cocking lever 104 passes through a radially extending slot 106 in the aft end of the body 10 and is fixed to the aft end of the firing pin. The cocking lever rides on the cam surface 108 of an annular firing cam 110 which has a low or forward uncocked level 112, a ramp or cocking level 114, an up or aft cocked level 116, and a firing drop off 118. A helical firing spring 120 is disposed on the firing pin and is compressed and released by the operation of the cocking lever.

Figures 9, 10, 11:
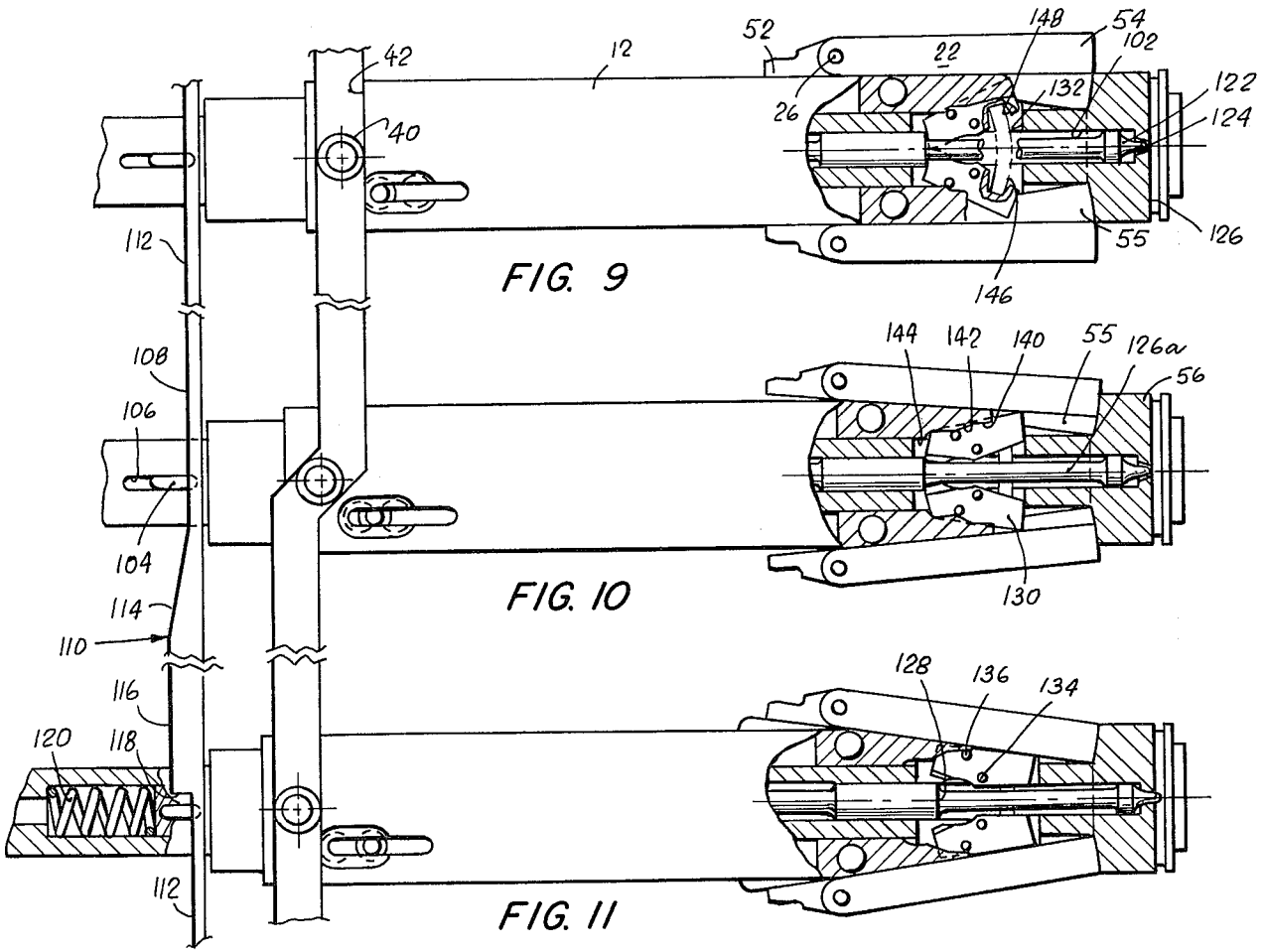
FIG. 9 is a top view in partial cross-section of the gun bolt of FIG. 1 showing a portion of the firing pin mechanism and the gun bolt unlocked.
FIG. 10 is similar to FIG. 9 but showing the gun bolt partially locked.
FIG. 11 is similar to FIG. 10 but showing the gun bolt fully locked.
Figure 14:
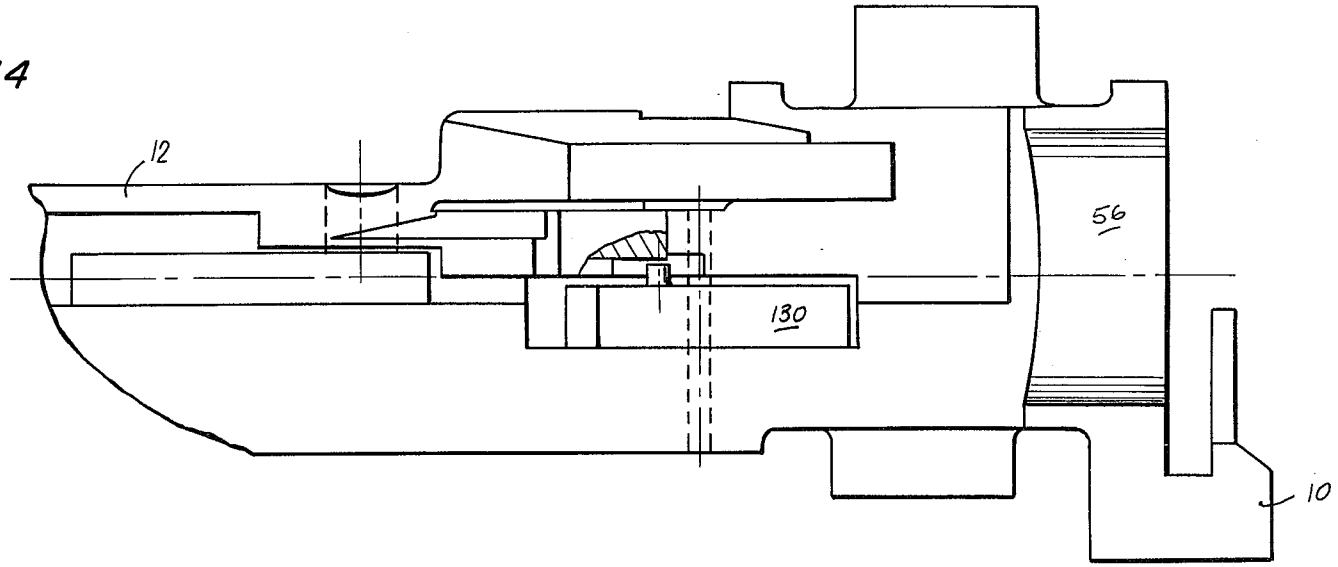
FIG. 14 is a detail side view of the gun bolt with locking lug removed.
Figure 13:
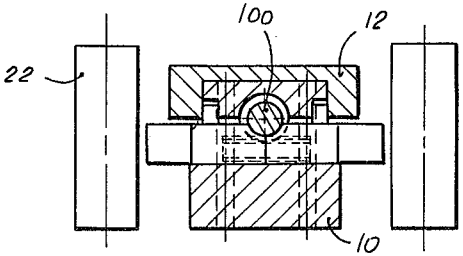
FIG. 13 is a detail view in front cross-section of the gun bolt showing a portion of the firing pin mechanism.
Figure 12:
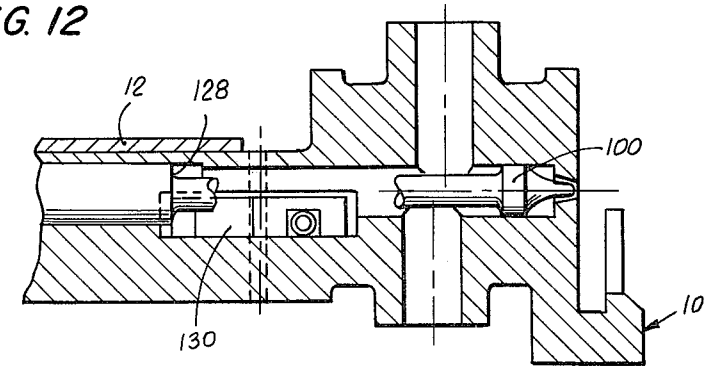
FIG. 12 is a detail view in side longitudinal cross-section of the gun bolt showing a portion of the firing pin mechanism.

The firing pin has a substantially conical head 122 which is adapted to pass through a reduced opening 124 into the face 126 of the head 56 of the gun bolt. The pin has a portion 126*a* of reduced diameter which provides a forward facing annular shoulder 128. A pair of retainer lugs 130 are disposed in a cross-slot 132 formed in the bolt body and extending between the recesses 55. Each lug 130 is pivotally mounted to the body by a pin 134 passing through respective bores in the bolt body. Each lug 130 also has a cam follower pin 136 projecting therefrom. The forward underside portion of the slide 12 has a part of stepped cam surfaces 140, 142, 144, for driving the respective pins 136. The forward ends of the retainer lugs 130 are normally biased apart by a helical compression spring 146 whose ends project into blind bores 148 in the lugs 130. The aft ends of the lugs, which have respective curved surfaces to straddle the reduced portion 126*a* of the firing pin, are thus normally biased together and abut the forward facing shoulder 128 of the firing pin, thereby precluding forward movement of the firing pin. When the slide 12 is forward relative to the bolt body, in the bolt unlocked disposition shown in FIG. 9, the part of inner cam surfaces 144 respectively abut the pair of cam follower pins 136, and holds the part of retainer lugs 130 in their firing pin blocking disposition. When the slide 12 is aft relative to the bolt body, in the bolt locked disposition shown in FIG. 11, the cam surfaces 144 are clear of the pair of cam follower pins 136, but the spring 146 would continue to bias the aft ends of the retainer lugs together. However, when the forward ends 54 of the bolt locking lugs 22 are each present and are swung inwardly into their bolt locking disposition, they respectively abut the forward ends of the retainer lugs 130 and cam them together against the bias of the spring 146, so that the aft ends of the retainer lugs 130 clear the annular shoulder 128 and the firing pin is free to move forward under the control of the cocking lever 104 and the spring 120. If both locking lugs 22 are not present and swung into their bolt locking dispositions, the retaining lugs will not both be released from the annular shoulder 128, and the firing pin will be blocked from camming forward and projecting forward of the face of the gun bolt, irrespective of the action of the cocking lever and the main spring.

While the invention has been shown embodied in a Gatling type gun, it will be obvious that it has application to single barrel guns wherein the gun bolt is driven by rotating drum cam, such as is shown in U.S. Pat. No. 1,786,207 issued to R. F. Hudson on Dec. 23, 1930. In such case the two cam tracks 36 and 42 will be formed on the drum cam, rather than on the housing, and the gun bolt assembly will reciprocate in the receiver. In either case relative motion is provided between the cam tracks and the gun bolt assembly.

What is claimed is:

1. A gun having a longitudinal axis and comprising:
a receiver;
a chamber;
a gun bolt movable along a path in said receiver parallel to said axis to and between the aft disposition whereat said chamber is open and a forward disposition whereat said chamber is closed by said gun bolt;
said gun bolt having a bolt face and carrying a firing pin, and a control means;
said firing pin being movable along a path in said gun bolt to and between an aft disposition whereat the forward end of said pin is aft of said bolt face and a forward disposition whereat said forward end is forward of said bolt face;
said control means being movable along a path to and between an aft disposition and a forward disposition relative to said gun bolt;
gun bolt locking means carried by said receiver and movable by said control means to and between a first disposition whereat said gun bolt is locked to said receiver to fixedly close said chamber and a second disposition whereat said gun bolt is free of said bolt locking means;
firing pin locking means carried by said gun bolt and movable to and between a first disposition whereat it interferes with movement of said firing pin and a second disposition whereat said firing pin is free to said pin locking means, said pin locking means being normally biased to its first disposition;
said bolt locking means, if and only if, it is substantially in its first disposition whereat said gun bolt is locked thereby positively causing said pin locking means to move to its second disposition whereat said pin is free thereof.

2. A gun according to claim 1 further including:
a cyclically operating first cam means for positively driving said gun bolt fore and aft in said receiver;
a cyclically operating second cam means for positively driving said control means fore and aft relative to said bolt; and
a cyclically operating third cam means for positively cocking and thereafter releasing said firing pin.

3. A gun according to claim 2 wherein:
said gun bolt locking means includes a pair of first lugs, each pivotally mounted to said receiver.

4. A gun according to claim 3 wherein:
said firing pin locking means includes a pair of second lugs, each pivotally mounted to said gun bolt, each one of said second lugs being disposed to be moved to its respective second disposition by a respective one of said first lugs being in its respective first disposition.

5. A gun according to claim 4 wherein:
said control means has a pair of first cam means for respectively positively moving said pair of first lugs to their respective first dispositions wherein said control means is in its aft disposition and a pair of second cam means for respectively positively moving said pair of first lugs to their respective second dispositions when said control means is in its forward disposition.

* * * * *

UNITED STATES PATENT AND TRADEMARK OFFICE

CERTIFICATE OF CORRECTION

PATENT NO. : 4,345,505

DATED : August 24, 1982

INVENTOR(S) : Raymond A. Patenaude et al.

It is certified that error appears in the above-identified patent and that said Letters Patent are hereby corrected as shown below:

Column 3, line 15, change "of" to --to--.

Column 3, line 33, delete --and--.

Signed and Sealed this

*Twenty-fourth* Day of *May 1983*

[SEAL]

*Attest:*

DONALD J. QUIGG

*Attesting Officer*

*Acting Commissioner of Patents and Trademarks*